US005107175A

United States Patent [19]

Hirano et al.

[11] Patent Number: 5,107,175

[45] Date of Patent: Apr. 21, 1992

[54] MOISTURE TRAPPING FILM FOR EL LAMPS OF THE ORGANIC DISPERSION TYPE

[75] Inventors: Hisakazu Hirano, Takatsuki; Kiju Mori, Machida; Junichi Watanabe; Fumio Kondo, both of Yokohama, all of Japan

[73] Assignees: Sumitomo Bakelite Company Limited; Stanley Electric Co., Ltd., both of Tokyo, Japan

[21] Appl. No.: 541,688

[22] Filed: Jun. 21, 1990

[30] Foreign Application Priority Data

Jun. 27, 1989 [JP] Japan ..... 1-162763

[51] Int. Cl.[5] ..... H05B 33/04

[52] U.S. Cl. ..... 313/512; 428/690; 428/917

[58] Field of Search ..... 313/512; 428/690, 917

[56] References Cited

U.S. PATENT DOCUMENTS 3,110,837 11/1963 Wollentin .
3,281,619 10/1966 Greene ..... 313/512 X
4,593,228 6/1986 Albrechtson et al. ..... 313/512 X
4,687,968 8/1987 Frayer ..... 313/512 X

FOREIGN PATENT DOCUMENTS 0374050 12/1989 European Pat. Off. .
1309655 1/1962 France .
0350907 7/1989 Japan .

OTHER PUBLICATIONS

Database Derwent World Patent Index, AN 88-297217, Derwent Publications Ltd., London, GB; & JP-A-63 218 351 (Sumitomo) Sep. 10, 1988/Abstract.
Database Derwent World Patent Index, AN 88-304646, Derwent Publications Ltd., London, GB; & JP-A-63 224 944 (Sumitomo) Sep. 20, 1988/Abstract.
Database Derwent World Patent Index, AN 89-169563, Derwent Publications Ltd., London, GB; & JP-A-1 110-955 (Daicel) Apr. 27, 1989/Abstract.

*Primary Examiner*—Palmer C. DeMeo
*Attorney, Agent, or Firm*—Browdy and Neimark

[57] ABSTRACT

A moisture trapping film for EL lamps of the organic dispersion type wherein a colorless, transparent adhesive layer having tackiness at room temperature is provided on one side or both sides of a colorless, transparent water-absorbing film.

7 Claims, 2 Drawing Sheets

MOISTURE TRAPPING FILM FOR EL LAMPS OF THE ORGANIC DISPERSION TYPE

FIELD OF THE INVENTION

The present invention relates to a moisture trapping film used for EL lamps of the organic dispersion type.

BACKGROUND OF THE INVENTION

In the structure of an electroluminescence (EL) lamp, as shown in FIG. 1, generally two sheets of moisture trapping films (2) hold between them a transparent conductive film (3), a luminescent layer (4) and an aluminum electrode (5) to protect the luminescent layer which is easily affected by water. Previously known moisture trapping films for this purpose are those composed of a water absorbing layer of nylon-6 laminated with an adhesive layer of nylon-12.

In addition to them, there have been moisture trapping films which employ hot-melt adhesives for the adhesive layer. These, however, are always designed to be laminated at a higher temperature between 100° and 200° C., and at room temperature the adhesive has no tackiness.

In the case of using such a moisture trapping film having no tackiness at room temperature, the impact at the stamping readily caused peeling of the moisture trapping film and reduced the yield. This has been a great problem particularly for a large size EL lamp.

Furthermore, when an EL lamp was bent to be used, conventional adhesives caused peeling and provided the lamp with an inferior appearance.

On the other hand, for the most outer layer of moistureproof film (1) also an adhesive of the hot-melt type was used, and the lamination was carried out at a temperature between 100° and 150° C. The higher temperature process of adhesion between the moisture trapping layer and the moistureproof film provided the life of the EL lamp with a markedly poor effect.

SUMMARY OF THE INVENTION

The object of the present invention is to provide a moisture trapping film for EL lamps which could not be obtained by the conventional methods, that is a moisture trapping film which generates no peeling caused by the impact in the stamping process, and which withstands the use on curved surfaces, and also which makes possible to effect lamination of a moisture trapping film with a moistureproof film at lower temperatures.

The present invention is a moisture trapping film for EL lamps of the organic dispersion type wherein a colorless, transparent adhesive layer having tackiness at room temperature is provided on one side or both sides of a colorless, transparent water-absorbing film.

DETAILED DESCRIPTION OF EMBODIMENTS

The water-absorbing film used in the present invention may be any colorless, transparent film which has a moisture absorption of at least 0.5% by weight in the atmosphere of 60% relative humidity at 20° C. The material for such a water-absorbing film includes, for example, polyamide resin, polyvinyl alcohol, polyvinyl acetate, polyvinyl acetate alcohol, cellulose and derivatives thereof. These may be either a homopolymer or copolymer.

The adhesive layer used in the present invention comprises the so-called pressure sensitive adhesive, the material of which includes, for example, acrylic resin, polybutadiene resin, chloroprene resin, isoprene resin, silicone resin, polyurethane resin, natural rubber and derivatives thereof. These may be either a homopolymer or copolymer.

It is important that the adhesive and the water-absorbing film used in the present invention must be colorless and transparent. If they are not colorless and transparent, the luminance of an EL lamp is decreased and the color tone is degraded. If the adhesive layer is too thick, the transparency is decreased, while if it is too thin, the adhesive strength is decreased. Thus, preferably an adhesive layer having a thickness of from 1 to 100 μm is suitable for the present invention.

Similarly, if the water-absorbing film is too thick, the transparency is decreased, while if it is too thin the water absorption is too much decreased to protect the luminescent layer. Thus, preferably a water-absorbing film having a thickness of from 20 to 500 μm is suitable for the present invention.

When a resin which has tackiness at room temperature is applied as the adhesive to laminate the moisture trapping films with the composite of transparent conductive film/luminescent layer/aluminum electrode, the adhesive layers act to absorb impact and strain. This makes it possible to provide an EL lamp with high impact resistance and flexibility which could not be obtained with the conventional moisture trapping films. Furthermore, the moisture trapping films and the moistureproof film are bonded with each other at lower temperatures, so that little degradation of the luminescent layer occurs. This makes it possible to provide an EL lamp with a long life.

That is to say, by using the moisture trapping film of the present invention not only the yield of the processing step has been improved, but also the application to more steeply curved surfaces has been possible. Further, the film can be processed at lower temperatures and has extended the life of an EL lamp. Therefore, the moisture trapping film of the present invention is very suitable as a moisture trapping film for EL lamps.

Figure 1:
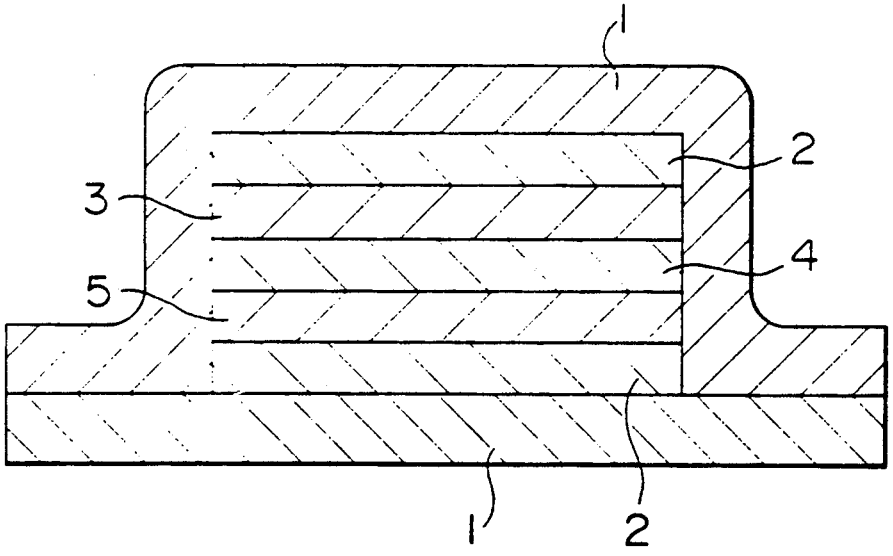
FIG. 1 (PRIOR ART)
FIG. 1 is a sectional view showing general structure of an EL lamp according to the prior art.
Figure 2:
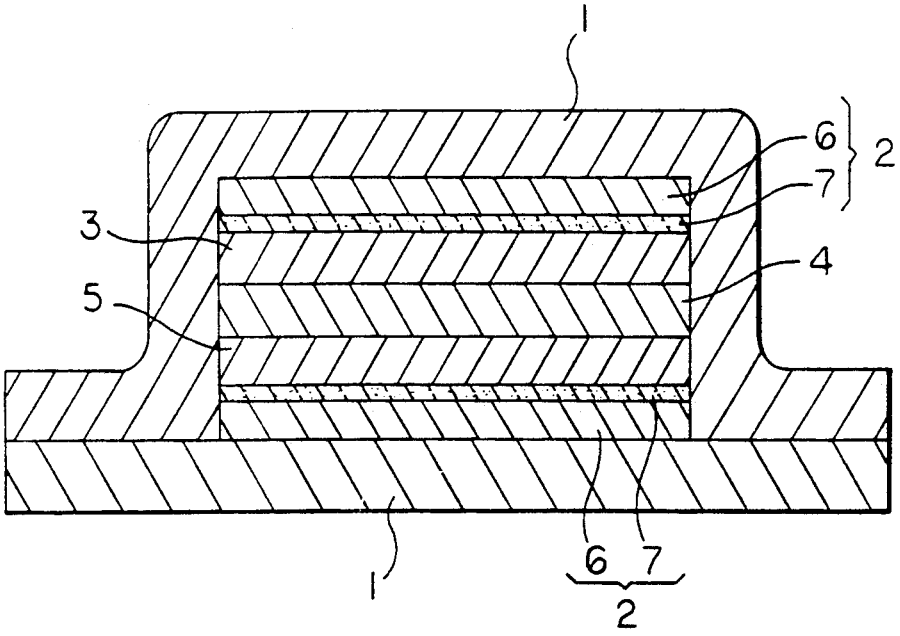
FIG. 2 is a sectional view showing a construction according to the present invention utilizing the moisture trapping film of the present invention.

FIG. 2 shows the structure of an EL lamp according to the present invention which is similar to that of FIG. 1 and wherein like reference numerals correspond to like parts, it being seen in FIG. 2, however, that the moisture trapping films 2 each constitute a water absorbing film 6 and a colorless, transparent adhesive layer 7 having tackiness at room temperature.

EXAMPLE 1

A nylon-6 film (80 μm) was coated with a polyurethane pressure sensitive adhesive in a thickness of 15 μm for the adhesive layer to make a moisture trapping film. This was laminated on both sides of a composite of transparent conductive film/luminescent layer/aluminum electrode at room temperature. The laminate thus obtained was cut into 20 mm×100 mm, and then provided with a moistureproof packaging to make an EL lamp.

In the process of cutting no peeling was found, and the yield was 100%. When the EL lamp thus composed was bent to 100 mm R, no peeling was found, and hence the EL lamp can withstand the application to curved surfaces.

COMPARATIVE EXAMPLE

Instead of the moisture trapping film of Example 1, a nylon-6 film coated with nylon-12 as the adhesive was employed. Differently from the case of Example 1, this film could not be laminated at room temperature, and hence the processing temperature was raised to 170° C. The laminate made at this temperature was cooled to room temperature, and then similarly to Example 1 was cut and provided with a moisture proof packaging.

Due to the partial peeling of the moisture trapping film caused by the impact at the time of cutting work, 4 to 5% of EL lamps were condemned. Furthermore, when the good products of EL lamps were bent to 100 mm R, in 30 to 40% of the lamps peeling of the moisture trapping film occurred. Therefore, the moisture trapping film was very easily peelable in comparison with that of Example 1.

The moisture trapping film of Example 1 and that of Comparative Example showed little difference in their adhesion strengths themselves on the peeling test at room temperature (T-peel, peeling speed: 200 mm/min). The difference between them in the cutting work and the bending use as mentioned above is due to the difference of whether the adhesive layer can absorb impact and strain or not.

EXAMPLE 2

A nylon-6 film (80 μm) was coated on the both sides with an acrylic pressure sensitive adhesive in a thickness of 15 μm for the adhesive layer to make a moisture trapping film. Then this moisture trapping film was laminated on the both sides of a composite comprising "transparent conductive film/luminescent layer-/aluminum electrode" at room temperature. This was cut into 200 mm×100 mm, and laminated on the both sides with a moistureproof film comprising fluoropolymer film at room temperature. Then only the edge part of the moistureproof film was sealed at 130° C.

An accelerating test was carried out with the EL lamp thus prepared and a conventional EL lamp which was made by laminating a moisture trapping film using an ordinary hot-melt type adhesive and a moistureproof film at 150° C. respectively. For the test conditions, the EL lamps were lighted up at 100 V, 400 Hz, and kept at 60° C., 80% RH. In the initial period the both lamps had a luminance of 18 foot-lambert. After 250 hours, while the luminance of the conventional EL lamp fell to 6 foot-lambert, the luminance of the EL lamp according to the present invention exhibited only a decay to 12 foot-lambert. From this result, it is apparent that the moisture trapping film according to the present invention has a flexibility, improves the yield on production, and furthermore has an effect to extend the life of EL lamps.

We claim:

1. A moisture trapping film for EL lamps of the organic dispersion type wherein a colorless, transparent adhesive layer having tackiness at room temperature is provided on one side or both sides of a colorless, transparent water-absorbing film.

2. A moisture trapping film according to claim 1 wherein said water-absorbing film is prepared from a material selected from the group consisting of polyamide resin, polyvinyl alcohol, polyvinyl acetate, polyvinyl acetate alcohol, cellulose and derivatives thereof.

3. A moisture trapping film according to claim 1 wherein said adhesive layer is prepared from a material selected from the group consisting of acrylic resin, polybutadiene resin, chloroprene resin, isoprene resin, silicone resin, polyurethane resin, natural rubber and derivatives thereof.

4. A moisture trapping film according to claim 1 wherein said water-absorbing film has a thickness of from 20 to 500 μm.

5. A moisture trapping film according to claim 1 wherein said adhesive layer has a thickness of from 1 to 100 μm.

6. In an electroluminescence lamp comprising two sheets of moisture trapping films holding therebetween a transparent conductive film, a luminescent layer and an electrode, and encapsulated within a moisture proof material, the improvement wherein said moisture trapping films each comprise a colorless, transparent water-absorbing film having coated on at least one surface thereof a colorless, transparent adhesive layer having tackiness at room temperature and having a thickness of less than 100 μm.

7. An electroluminescence lamp according to claim 6 wherein said adhesive layer is selected from the group consisting of polyamide resin, polyvinyl alcohol, polyvinyl acetate, polyvinyl acetate alcohol, cellulose and derivatives thereof.

* * * * *